US006757938B1

(12) United States Patent
di Vinadio

(10) Patent No.: US 6,757,938 B1
(45) Date of Patent: Jul. 6, 2004

(54) HINGE FOR AN OPENING DOOR OR WINDOW FRAME

(75) Inventor: Aimone Balbo di Vinadio, Milan (IT)

(73) Assignee: SAvio SpA, Turin (IT)

( * ) Notice: Subject to any disclaimer, the term of this patent is extended or adjusted under 35 U.S.C. 154(b) by 446 days.

(21) Appl. No.: 09/592,578

(22) Filed: Jun. 12, 2000

(30) Foreign Application Priority Data

Jun. 16, 1999 (IT) ..... TO99A0521

(51) Int. Cl.[7] ..... E05D 7/04

(52) U.S. Cl. ..... 16/242; 16/243; 16/245; 16/238

(58) Field of Search ..... 16/242, 243, 245, 16/246, 238

(56) References Cited

U.S. PATENT DOCUMENTS

| | | | | |
|---|---|---|---|---|
| 863,128 A | * | 8/1907 | Aebi | 16/242 |
| 3,146,486 A | * | 9/1964 | Hoffman | 16/237 |
| 5,263,227 A | * | 11/1993 | Hrbek et al. | 16/224 |
| 5,755,011 A | * | 5/1998 | Green et al. | 16/238 |

FOREIGN PATENT DOCUMENTS

| | | | |
|---|---|---|---|
| DE | 2628951 A1 | * | 6/1976 |
| DE | 37 40 031 A | | 6/1989 |
| DE | 89 14 003 U | | 1/1990 |
| WO | WO 98 41720 A | | 9/1998 |

* cited by examiner

*Primary Examiner*—Anthony Knight
*Assistant Examiner*—Mark Williams
(74) *Attorney, Agent, or Firm*—Sughrue Mion, PLLC

(57) ABSTRACT

Hinge for an opening door or window frame including a first and a second knuckle part connected together by a pin and assembled so as to allow adjustment between the first and second knuckle parts in a direction parallel to and in a direction perpendicular to the general plane of the door or window, respectively. For the purposes of adjustment perpendicular to the plane of the door or window, a sleeve is provided which can be oriented inside the second knuckle part. The sleeve and the pin have surfaces that come into mutual axial contact and are spherical in shape. Spherical surfaces are also provided between the sleeve and a support which is screwed into the bottom of the second knuckle part in order to adjust the height of the first knuckle part.

4 Claims, 2 Drawing Sheets

HINGE FOR AN OPENING DOOR OR WINDOW FRAME

BACKGROUND OF THE INVENTION

Figure 1:
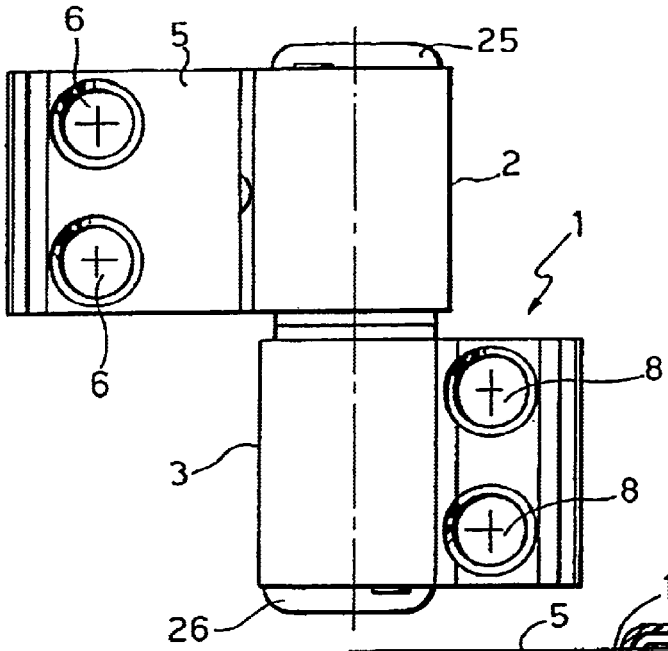

The present invention relates to hinges for an opening door or window frame, of the type comprising one first and at least one second knuckle part each provided with a leaf for fixing it to the movable frame and to the fixed frame respectively of the door or window; a pin which connects the first and second knuckle parts together such that they can rotate; and means allowing adjustments to be made between the first and second knuckle parts.

Hinges of this type are currently used in a multitude of applications, including on relatively heavy doors in which the frames consist of metal sections. In these applications, adjustment between the first and the second knuckle parts of the hinges on the door frame, in other words between the movable frame and the fixed frame, is usually possible both in a direction parallel to and in a direction perpendicular to the general plane of the door, advantageously independently of each other.

Adjustment perpendicular to the general plane of the door in particular serves to adjust the compression force on the seal, which is usually provided on one of the two frames, so as to give the optimum compression value to ensure a seal against external agents. Adjustment in a direction parallel to the general plane of the door, on the other hand, serves to adjust the gap between the movable frame and the frame proper.

Italian Utility Model Application No. TO97U000055 in the name of the present Applicant discloses a hinge for an opening door or window frame of the type defined above, in which the means allowing adjustment between the first and second knuckle parts perpendicular to the general plane of the door or window include a sleeve which is inserted into the second knuckle part such that it can be oriented angularly and which has an eccentric cylindrical cavity into which the pin is inserted. The sleeve and the second knuckle part have mutual keying means designed to allow stable orientation of the sleeve in a plurality of different relative angular positions.

This adjustment system has the advantage of allowing particularly practical, easy and rapid adjustment between the movable frame and the fixed frame of the door or window, perpendicularly to the latter's general plane.

SUMMARY OF THE INVENTION

The present invention constitutes an improvement to the subject-matter of the abovementioned Italian Utility Model Application No. TO97U000055 and, more specifically, its object is to make the hinge self-centring, especially with regard to the axial alignment between the pin and the second knuckle part, so as to eliminate any negative effects that may arise due to play introduced during construction or assembly between these components of the hinge.

According to the invention this object is achieved by a hinge for an opening door or window frame of the type defined at the outset which is principally characterized in that, in accordance with Claim 1, the abovementioned sleeve and the pin of the hinge have surfaces that come into mutual axial contact and are spherical in shape.

In a preferred embodiment of the invention the sleeve has a bottom wall which closes off its cavity, this bottom wall and the end of the pin that faces it both having an essentially hemispherical and mutually complementary shape.

If means for adjusting the height of the first knuckle part relative to the second knuckle part are also provided, and include a lower support for the said sleeve engaged inside the second knuckle part such that it can move axially, the invention will also envisage the said support and the said sleeve having surfaces that come into mutual axial contact and are spherical in shape.

In this way three spherical surfaces are defined which will ensure a perfect self-centring action between the pin, which is integral with the first knuckle part of the hinge, and the adjustment unit associated with the second knuckle part.

BRIEF DESCRIPTION OF THE INVENTION

Figure 3:
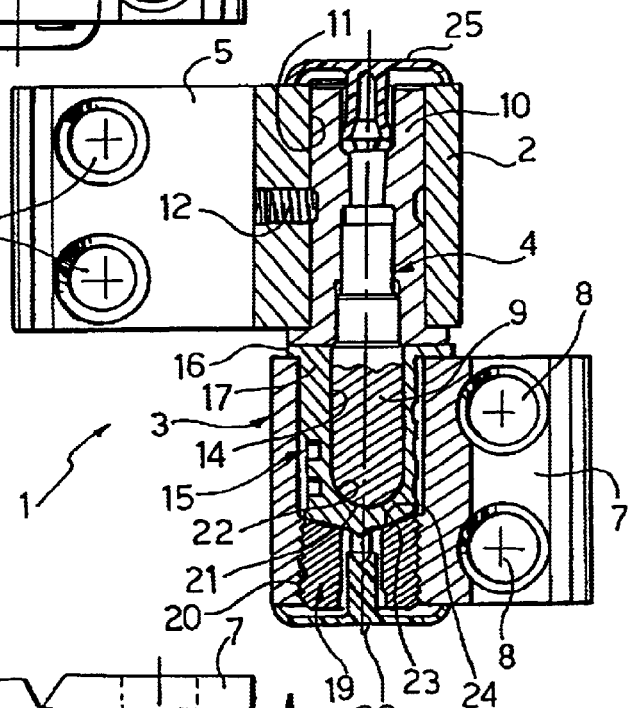
Figure 2:
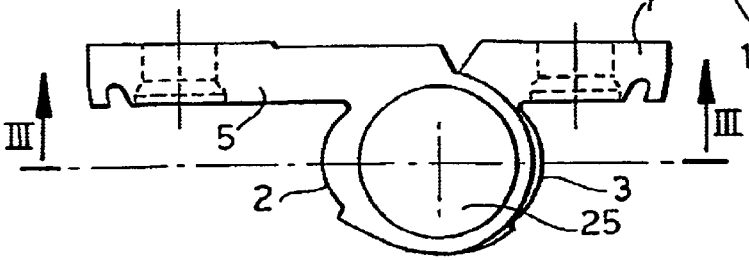
Figure 4:
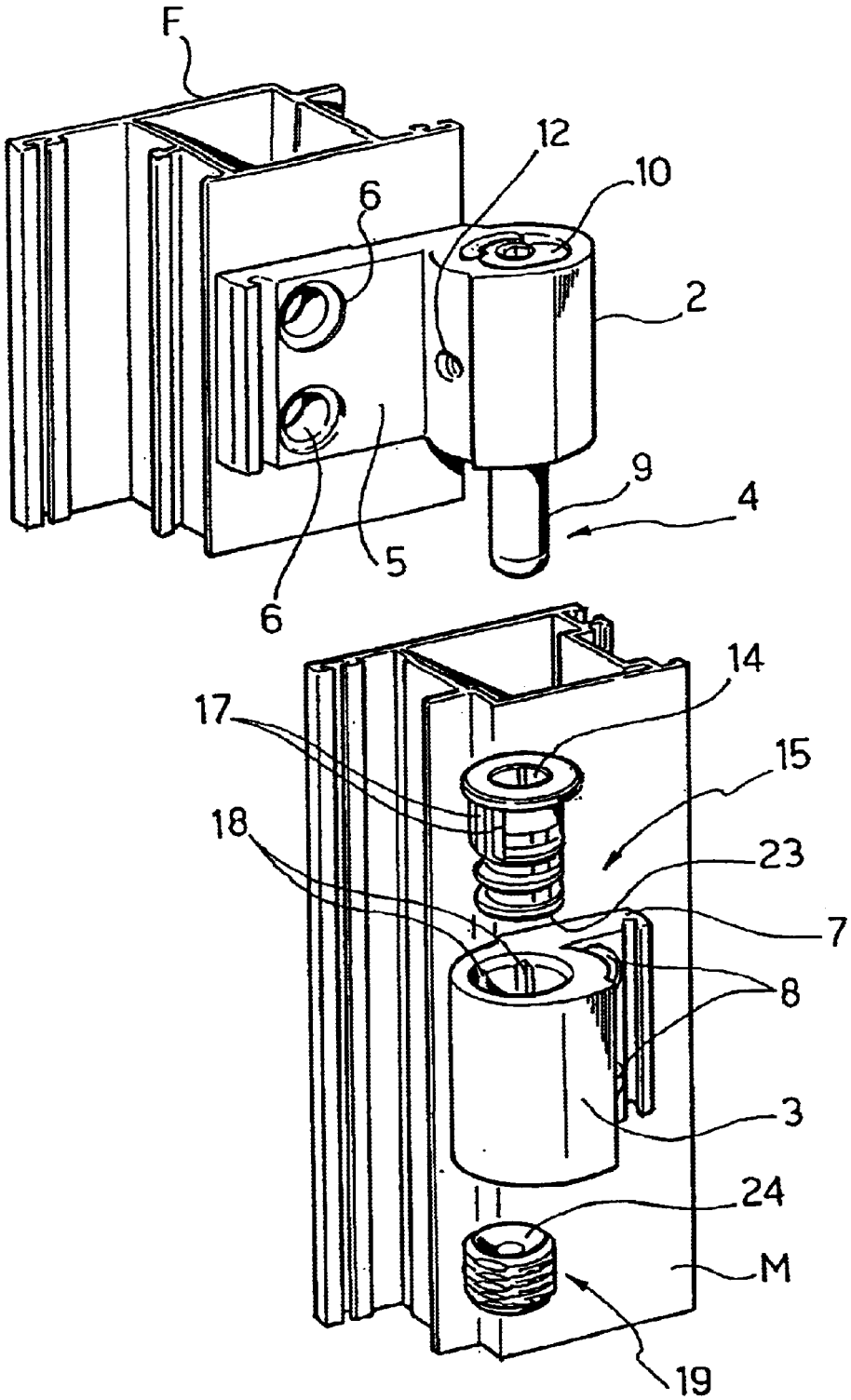

The invention will now be described in detail and with reference to the appended drawings which are supplied purely by way of non-limiting example and in which:

FIG. 1 is a schematic view in elevation of a hinge for an opening door or window frame according to the invention, FIG. 2 is a plan view of FIG. 1, FIG. 3 is view in vertical section on the plane III—III of FIG. 2, and FIG. 4 is a partially exploded perspective view of the hinge as applied to a door or window frame.

DETAILED DESCRIPTION OF THE INVENTION

In the drawings, the general reference 1 denotes a hinge according to the invention for an opening door or window frame, particularly, but not exclusively, for heavy doors and essentially comprising a first knuckle part 2 and a second knuckle part 3 which are placed axially one on top of the other and are connected together such that they can rotate by means of a pin, denoted as a whole by the reference 4.

The first knuckle part 2 is formed as a single piece with a leaf 5 which, in conjunction with screws (not shown) inserted into holes 6, serves to fix the hinge to an upright of a movable frame F (FIG. 4) of the door. Similarly, the second knuckle part 3 is formed as a single piece with a leaf 7 which, in conjunction with screws (not shown) inserted into holes 8, serves to fix the hinge to a corresponding upright of the fixed frame M (FIG. 4) of the door.

The pin 4 includes a lower part 9 which projects out from the bottom of the first knuckle part 2 and is inserted, as will be explained below, into the second knuckle part 3, and an upper part consisting of a cam, denoted by the general reference 10, which is rigidly connected to the lower part 9. The cam 10 can be made to rotate inside the cavity 11 of the first knuckle part 2 such that it causes only a relative translational movement between the first and the second knuckle parts 2, 3—and therefore of the movable frame F relative to the fixed frame M—in a direction parallel to the general plane of the door. In a manner described in a co-pending patent application filed on the same date by the Applicant, this enables the gap between the movable frame and the fixed frame to be adjusted. Once such adjustment has been made, the cam 10 is prevented from rotating relative to the first knuckle part 2 by tightening a lateral grub screw 12.

The lower part 9 of the pin 4 is engaged in a manner such that it can rotate inside the cavity 14 of a sleeve 15 which is usually made out of a self-lubricating plastic material with a low coefficient of friction. The cavity 14 of the sleeve 15 is eccentric relative to the second knuckle part 3 and the sleeve 15 has an annular flange 16 at the top which bears on the top edge of the second knuckle part 3. Moreover, the sleeve 15 is closed off at the bottom by a bottom wall 22, thus exhibiting an overall beaker-like shape so that it can also advantageously act as a reservoir for a lubricant.

The side wall of the sleeve 15 has one or more (advantageously three) spline-like axial projections 17 on the outside which are designed to engage in a series of longitudinal grooves 18 on the inside of the knuckle part 3. This mechanism is generally known from Italian Utility Model Application No. TO97U000055 referred to above, and allows adjustment between the first knuckle part 2 and the second knuckle part 3 in a direction perpendicular to the general plane of the door—in other words it allows adjustment of the pressure between the movable frame F and the fixed frame M. During assembly, the sleeve 15 is oriented by positioning the splines 17 in the grooves 18 corresponding to the desired value for the pressure between the movable frame F and the fixed frame M. Of course this pressure value, which is usually set by the door manufacturer, can be modified by the person installing the door by positioning the splines 17, i.e. the sleeve 15, in the most suitable angular position.

The hinge also includes a screw-like element 19 which is engaged in a lower tapped portion 20 of the second knuckle part 3 in order to adjust the vertical position of the sleeve 15 and, therefore, the height of the pin 4 and thus of the first knuckle part 2 relative to the second knuckle part 3.

According to the invention the internal contact surface between the lower part 9 of the pin 4 and the sleeve 15 on the one hand, and the external contact surface between this sleeve 15 and the threaded element 19 on the other, are spherical in shape in order to produce a self-centring action between the pin 4, and thus the first knuckle part 2, and the second knuckle part 3.

More specifically: the free end of the lower part 9 of the pin 4, denoted by the reference 21, and the bottom wall 22 of the cavity 14 of the sleeve 15 have a hemispherical and mutually complementary shape.

Similarly, the base of the sleeve 15, denoted by the reference 23, and the top 24 of the threaded element 19 both have an essentially hemispherical and mutually complementary shape.

In the example illustrated the radius of the spherical surfaces 21 and 22 is smaller than the radius of the spherical surfaces 23 and 24.

Protective caps 25, 26 are usually applied, in a manner such that they can be removed, to the top of the first knuckle element 2 and to the base of the second knuckle element 3, respectively.

It is worth noting that the invention can also be applied to hinges fitted with two, rather than just one, knuckle parts for fixing the hinge to the fixed frame of the door or window.

Needless to say, constructional details and particular embodiments may be amply varied with respect to those described and illustrated, without thereby departing from the scope of the present invention, as defined in the following claims.

What is claimed is:

1. A hinge for an opening door or window frame having a general plane and including a movable frame and a fixed frame, said hinge comprising one first and at least one second knuckle part each provided with a leaf for fixing it to said movable frame and to said fixed frame respectively of the door or window, a pin which connects said first and second knuckle parts together such that they can rotate, and adjustment means allowing adjustments to be made between said first and second knuckle parts in a direction perpendicular to the general plane of the door or window, said adjustment means including a sleeve which is adjustably mounted in said second knuckle part for angular adjustment about a longitudinal axis of the sleeve and has an eccentric cylindrical cavity into which said pin is inserted, wherein said sleeve has a bottom wall which closes off the cavity at the bottom thereof, said bottom wall and the end of the pin that faces it both having an essentially hemispherical and mutually complementary shape, and further comprising means for adjusting the height of the first knuckle part relative to the second knuckle part, said means including a lower support for said sleeve engaged inside said second knuckle part such that the lower support can move axially, wherein said support and said sleeve have surfaces that come into mutual axial contact and are hemispherical in shape with the hemispherical surfaces of the bottom wall and the support being concave with the concavity of each facing toward each first knuckle part.

2. Hinge according to claim 1, wherein said sleeve acts as a reservoir for a lubricant.

3. Hinge according to claim 1, wherein said sleeve and the said second knuckle part have mutual keying means designed to allow stable orientation of the sleeve in a plurality of different relative angular positions.

4. Hinge according to claim 1, wherein said support is screwed into said second knuckle part.

* * * * *